US010139784B2

(12) United States Patent
Kissling

(10) Patent No.: US 10,139,784 B2
(45) Date of Patent: Nov. 27, 2018

(54) WATCH COMPRISING A CALENDAR DISPLAY MECHANISM

(71) Applicant: Omega SA, Biel/Bienne (CH)

(72) Inventor: Gregory Kissling, Macolin (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 15/807,628

(22) Filed: Nov. 9, 2017

(65) Prior Publication Data

US 2018/0157215 A1 Jun. 7, 2018

(30) Foreign Application Priority Data

Dec. 1, 2016 (EP) ..... 16201647

(51) Int. Cl.
*G04B 19/24* (2006.01)
*G04C 3/14* (2006.01)
*G04C 17/00* (2006.01)

(52) U.S. Cl.
CPC ..... *G04B 19/241* (2013.01); *G04C 3/146* (2013.01); *G04C 17/00* (2013.01)

(58) Field of Classification Search
CPC ..... G04B 19/241; G04B 19/24; G04C 3/146; G04C 17/00
See application file for complete search history.

(56) References Cited

U.S. PATENT DOCUMENTS 1,846,962 A * 2/1932 Gries ..... G04B 19/241 368/34
3,190,022 A * 6/1965 Maitre ..... G04B 19/241 368/10
4,266,288 A 5/1981 Berney
5,235,562 A * 8/1993 Vaucher ..... G04B 19/02 368/28
5,469,410 A * 11/1995 Berney ..... G04B 19/087 368/18
5,959,941 A * 9/1999 Murakami ..... G04F 8/00 368/110
6,735,151 B2 * 5/2004 Triponez ..... G04B 19/20 368/28

(Continued)

FOREIGN PATENT DOCUMENTS

EP 2 562 609 A1 2/2013
FR 2 404 250 4/1979
WO WO 2005/091086 A1 9/2005

OTHER PUBLICATIONS

European Search Report dated May 15, 2017 in European application 16201647.1, filed on Dec. 1, 2016 (with English Translation of Categories Cited Documents).

*Primary Examiner* — Sean Kayes
(74) *Attorney, Agent, or Firm* — Oblon, McClelland, Maier & Neustadt, L.L.P.

(57) ABSTRACT

The present invention proposes an electronic watch including a display device comprising a time dial, a first hand and a second hand which pivot coaxially, independently driven by two drive members, and in a first display mode, one hand indicates the hour and the other indicates the minutes of the current time in reference to their respective positions on the time dial. In an original manner, the watch further includes a control member able to activate a second display mode, in which the first and second hands are positioned in reference to the time dial so as to respectively indicate the tens and units of the date.

13 Claims, 1 Drawing Sheet

(56) References Cited

U.S. PATENT DOCUMENTS

| | | | | |
|---|---|---|---|---|
| 7,170,824 | B2 * | 1/2007 | Wilmouth | G04B 19/241 368/18 |
| 7,596,057 | B2 * | 9/2009 | Linder | G04C 3/146 368/228 |
| 8,848,491 | B2 * | 9/2014 | Miyake | G04C 3/146 368/228 |
| 2006/0280037 | A1 | 12/2006 | Houlon et al. | |
| 2008/0170474 | A1 * | 7/2008 | Behling | G04B 19/247 368/37 |
| 2008/0253235 | A1 * | 10/2008 | Hiraga | G04B 19/082 368/172 |
| 2013/0051189 | A1 | 2/2013 | Springer | |
| 2015/0131412 | A1 | 5/2015 | Springer | |

* cited by examiner

WATCH COMPRISING A CALENDAR DISPLAY MECHANISM

This application claims priority from European patent application No. 16201647.1 filed on Dec. 1, 2016, the entire disclosure of which is hereby incorporated herein by reference.

FIELD OF THE INVENTION

The present invention relates to the field of horology. It more particularly concerns an electronic watch including a calendar display device.

PRIOR ART

It is known to make watches including a display of the date, i.e. the sequential number of the current day of the month. This display is conventionally achieved by means of a rotating annular disc on which the numerals from one to thirty-one are inscribed. The date-disc is placed underneath the dial in which an aperture is arranged to reveal the date of the current day. The watch mechanism drives the disc in rotation at the change of date to increment the day of the month by one unit. The return to the 1st, at the end of a month of less than 31 days, is performed manually or automatically.

Alternatively, the date can be indicated by means of a pivoting hand. To achieve this, the date numerals are at least partially inscribed on the dial in the hour-circle or on an additional dial. There is known, for example, from EP Patent Application No 0617346 which discloses a watch having a chronograph provided, as appropriate, with a large or a small seconds hand. The seconds hand can be reassigned on demand to the date indication when the chronograph is not being used. In the case where the large seconds hand is reassigned to the date display, the numerals from one to thirty-one are marked on the hour-circle.

WO Patent Application No 94/03845 is also known, which discloses an electronic watch having a date display achieved by means of two additional dials whose hands indicate the tens and units of the date.

However, the various types of known date displays have several drawbacks. Display by means of a rotating disc or by dials with dedicated hands requires developing specific parts and mechanisms which makes these watches more complex to develop and to manufacture and increases their dimensions. In the case of a hand display, the date inscriptions, which are made directly on the dial, overload the latter and make the time indications confusing to read. Regardless of the type of date display, the amount of information to be displayed necessitates a reduced character size, which impairs readability, particularly in small watches. To overcome this, some watches with a date display in an aperture provide a magnifying glass on the crystal, which is an unattractive and expensive solution. Further, known date display devices require specific markings or display means, which are incompatible with clean design watches.

SUMMARY OF THE INVENTION

It is an object of the present invention to overcome these different drawbacks by proposing an electronic watch with a date display which is simpler to manufacture, easier to read and offers improved aesthetics.

More precisely, the invention concerns an electronic watch including a display device comprising a time dial, a first hand and a second hand which pivot coaxially, independently driven by two drive members, and in a first display mode, one hand indicates the hour and the other indicates the minutes of the current time in reference to their respective positions on the time dial. In an original manner, the watch further includes a control member able to activate a second display mode, in which the first and second hands are positioned in reference to the time dial to respectively indicate the tens and units of the date.

This arrangement offers a compact and inexpensive means of displaying the date without having to develop specific extra display means. It also improves the readability of information, especially for small-format watches. Finally, by dispensing with additional display or marking means, it allows clean design watches to be obtained.

BRIEF DESCRIPTION OF THE FIGURES

Other details of the invention will appear more clearly upon reading the following description, made with reference to the annexed drawing, in which.

DETAILED DESCRIPTION

Figure 1:
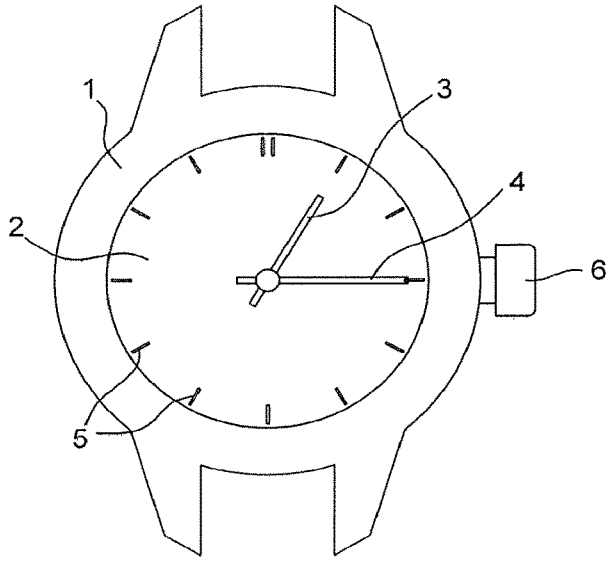
FIG. 1 represents a view of the case middle and of the dial of a watch according to the invention.

FIG. 1 represents an electronic watch made in accordance with the teaching of the invention. It includes a middle part 1 in which there is a conventional analogue display composed of a time dial 2, a first hand 3 and a second hand 4, which are pivotally and coaxially mounted at the centre of dial 2. On the hour-circle, at the periphery of the dial, there are twelve reference marks 5, regularly spaced at thirty degrees, which are intended to identify the angular position of hands 3, 4 on time dial 2, to facilitate reading of the time indications. A control member 6, whose role will be described below, is shown in the three o'clock position.

The watch also includes a drive mechanism, an electronic timekeeper circuit supplying a time base signal from a time base connected to a division circuit, the electronic timekeeper circuit being powered by an electrical energy source (not represented). The watch includes a first motor actuated by the divided time base signal to clock the hours, via a first control circuit, which drives an analogue time display 3, and a second motor actuated by the divided time base signal to clock the minutes, via a second control circuit, which drives an analogue minute display 4. The two hands are not, therefore, kinematically connected by the drive mechanism but are driven by two independent stepping motors controlled by the electronic circuit. The timekeeper circuit further includes means for deriving a daily signal from the time base signal, at the end of every day, and a calendar circuit including at least one day counter activated by the daily signal, the counter including a sub-counter for the tens of the date and a sub-counter for the units of the date. The first and second control circuits respectively for the first and second motors also respectively receive a signal from the tens sub-counter and a signal from the units sub-counter, the signals from the two sub-counters being representative of their increment status.

In a first display mode, one hand 3, 4, indicates the hour and the other indicates the minutes of the current time, in reference to their respective angular positions on time dial 2. The time is set, for example, by rotating control member 6, which is pre-positioned axially in a setting position. In this display mode and during time-setting, the position of one of hands 3, 4, is electronically slaved to the position of the other hand 3, 4, so that the angular positions of the two hands 3, 4 remain consistent with respect to the displayed time. Preferably, the driving hand is the hand indicating the minutes and the slaved hand is the hour hand.

The watch has a second display mode which can be activated on demand by pressing control member 6. This pressure generates a date request signal, so that in this second display mode, the watch indicates the date instead of indicating the time. The first control circuit can thus place first hand 3 in the position corresponding to the tens digit of the date representative of the status of the tens sub-counter, while the second control circuit places second hand 4 in the position corresponding to the units of the date representative of the status of the units sub-counter. Date-setting is carried out when the second display mode is activated, either by rotating control member 6 in the setting position, or by pressing a set button (not represented). Another press on control member 6 returns the watch to the first display mode. The return to the first display mode could also occur automatically after a predefined time lag.

In the embodiment presented in FIG. 1, the tens digits zero to three are given by first hand 3 respectively in the twelve o'clock to three o'clock positions on time dial 2. The units digits zero to nine are given by second hand 4, respectively in the twelve o'clock to nine o'clock positions. Thus, the positions of first hand 3 and second hand 4 respectively indicating the tens and the units of the date are in clockwise order. It seems more natural for the small hour hand to be first hand 3 indicating the tens and for the large minute hand to be second units hand 4, but this arrangement could also be reversed. In the configuration represented in FIG. 1, first hand 3 is in the one o'clock position and second hand 4 is in the three o'clock position. The date displayed is therefore the 13th. All the time information can be kept in the memory and changed via storage means, independently of the active display mode.

The invention also relates to a skeleton watch devoid of a dial. Generally, time dial 2 extends as a geometric object allowing the angular position of the hands to be identified in reference to the zenith position. It is not linked to a particular part of the watch, the angular reference could, for example, be given by the case middle, the plate or the crystal. Control member 6 is the time-setting crown here, but it could equally be a different means, such as a push button.

Thus, the watch according to the invention makes it possible to dispense with specific date display means, such as a date-disc or one or more additional dials.

It also offers better readability of the date compared to the other known display solutions using hands or a display in a small aperture. In fact, reading the tens and units digits as a function of the angular position of the hands is intuitive, since it is like reading the time on a dial. Further, the hands are of much larger size than the characters or graduations used for reading the date in prior art watches. It is thus easier to take in information at a glance and the risk of reading errors is decreased. Visually impaired people capable of reading the time but not the finer details may, for the first time, read the date in a watch with hands. Likewise, long-sighted people no longer need to put on their glasses to read this information. Unlike the prior art solutions, it is also possible to read the date in the dark provided that the hands and reference marks on the dial are luminescent.

Finally, the solution provided by the invention improves the aesthetics of the watch without impairing its functionality. The date function can thus be completely discreet and indiscernible.

Figure 2:
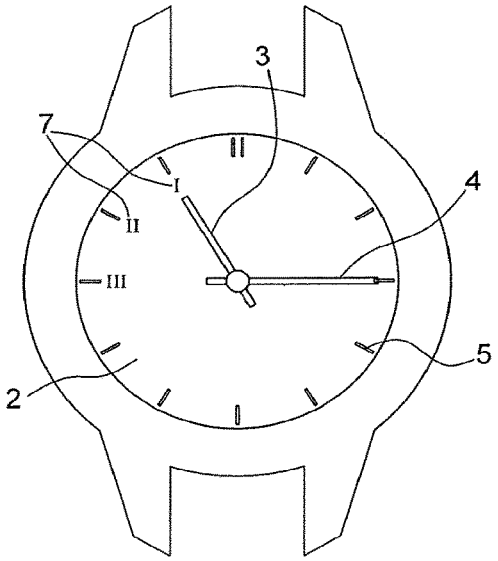
FIG. 2 represents a second embodiment.

FIG. 2 represents a variant of the date display of a watch according to the invention. In an original manner, the positions of first hand 3 and second hand 4 indicating the tens and units of the date are ordered in opposite directions, in the clockwise direction for the units and anticlockwise for the tens. The tens units zero, one, two and three of the date correspond to the respective positions of twelve, eleven, ten and nine o'clock on time dial 2. As in the first embodiment, the positions of second hand 4 indicating the units of the date from zero to nine correspond to the respective positions of twelve o'clock to nine o'clock on the time dial. Since the digit indicated does not correspond to the hour digit pointed to on the time dial, it may be advantageous to provide a mark 7 to facilitate the reading of the date with a reminder of the value corresponding to the position of a hand 3, 4. The date displayed in FIG. 2 is the thirteenth.

This configuration limits the risks of errors in reading the date that existed in the first embodiment. In the first mode presented, the first 3 and second 4 hands share the zero, one, two and three positions. On two days per month, the two hands are superposed, which may be a source of confusion especially where eyesight is impaired or in low visibility conditions. Moreover, it is possible to transpose the hand indicating the units and that indicating the tens. This risk may seem low given that the corresponding dates are separated by at least three days. However, the risk of confusion will be highest if the transposition occurs at the time that the date is being set. The configuration proposed in the second embodiment avoids this pitfall by separating the display areas for the tens and units. The twelve and nine o'clock positions are still shared, but there can be no superposition and the risk of transposition is limited since this would involve not only transposing the two hands in the same display area, but transposing the actual display areas as well as the hands.

Figure 3:
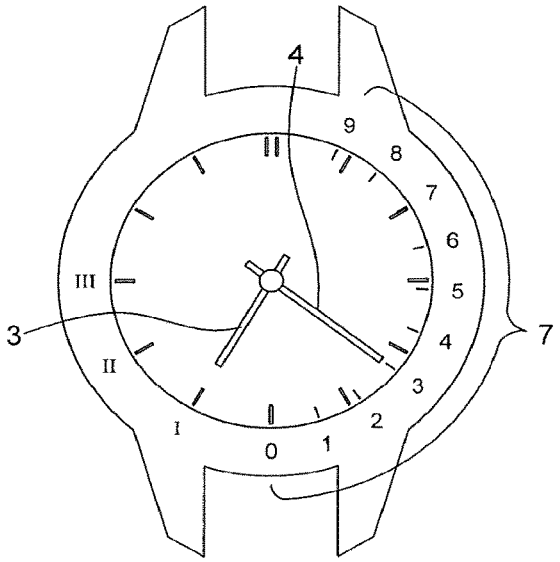
FIG. 3 represents the dial of a watch according to a third embodiment of the invention.

FIG. 3 represents a third embodiment of the date display, here too in the position indicating the number thirteen. In an original manner, the zero digit of the tens and of the units corresponds to a common six o'clock position on the time dial. Unlike the two preceding embodiments, the units of the date are in increasing order in the anticlockwise direction. The successive positions corresponding to the units are three minutes apart. The tens digits are in clockwise order and their position corresponds to the hourly reference marks of six, seven, eight and nine o'clock. A mark 7 of the digits corresponding to the units and to the tens of the date has been placed on the hour-circle for increased clarity. The angular space between the tens indications is thus different from that between the units indications, but could also be identical. Each of the units indicator marks from zero to nine are on the right part of the time dial from zero to six o'clock. Conversely, the tens indications are on the left part of the dial from six o'clock to twelve o'clock.

In this configuration, as in the tens display of the second embodiment, the values of the units or tens indicated by the hands in a given position no longer correspond to those of the hours on the time dial in the analogue position. The advantage of separating the dial into two parts in a vertical direction is to reproduce the natural arrangement of a two-digit number in which the tens digit is on the left of the units digit. This also follows the most common reading direction from left to right. Thus, it is more intuitive to read the date if the tens hand is in the left part of the dial and the units hand in the right part. It is also natural for the value zero to be in the six o'clock position, since the lowest position corresponds to the lowest value.

Those skilled in the art will be able to add many variants to the embodiments presented by combining their different features without departing from the scope of the invention defined by the claims. In particular, the positions marking zero for the units and for the tens could be distinct. In a variant of the second embodiment, the tens from zero to three respectively occupy the nine to twelve o'clock positions.

Preferably, and in place of one or other of the embodiments described above, the electronic timepiece circuit controlling the motors driving the display hands is arranged to control the date display according to a perpetual calendar type date circuit. A perpetual calendar circuit control unit including day, month and year counters controlling the rotation of a date-disc is known, for example, from the CH Patent No 663512 and U.S. Pat. No. 4,300,222 which are incorporated herein by reference with regard to the perpetual calendar control unit.

What is claimed is:

1. An electronic watch including a display device comprising a time dial, a first hand and a second hand which pivot coaxially, independently driven by two drive members, and in a first display mode, one hand indicates the hour, and the other indicates the minutes of the current time in reference to the respective position of said hands on the time dial, wherein the watch further includes a control member able to activate a second display mode, in which the first and second hands are positioned in reference to the time dial in order to respectively indicate the tens and units of the date.

2. The watch according to claim 1, wherein the watch includes reference marks arranged to identify the angular position of the hands on the time dial.

3. The watch according to claim 1, wherein the watch includes marks facilitating reading of the date.

4. The watch according to claim 1, wherein the angular positions of the first and second hands indicating the zero of the units and of the tens of the date in the second display mode are identical.

5. The watch according to claim 4, wherein the position corresponding to the zero of the units and of the tens is the twelve o'clock position.

6. The watch according to claim 4, wherein the position corresponding to zero of the units and of the tens is the six o'clock position.

7. The watch according to claim 1, wherein the positions of the second hand indicating the units digit of the date from zero to nine in the second display mode correspond to the respective positions of twelve o'clock to nine o'clock on the time dial.

8. The watch according to claim 1, wherein the positions of the first and second hands indicating the tens and the units of the date in the second display mode are in clockwise order.

9. The watch according to claim 1, wherein the tens digit of the date from zero to three in the second display mode corresponds to the respective positions of twelve to three o'clock on the time dial.

10. The watch according to claim 1, wherein the tens digits zero, one, two and three of the date in the second display mode correspond to the respective positions of twelve, eleven, ten and nine o'clock on the time dial.

11. The watch according to claim 1, wherein the positions of the first and second hands indicating the tens and the units of the date in the second display mode are ordered in different directions.

12. The watch according to claim 1, wherein, in the second display mode, the first hand is located between the six o'clock and twelve o'clock positions and the second hand is located between the twelve o'clock and six o'clock positions.

13. The watch according to claim 1, wherein the electronic timepiece circuit controlling the motors driving the display hands is arranged to control the date display in accordance with a calendar circuit of the perpetual calendar type.

* * * * *